US005236267A

United States Patent [19]

Masumura et al.

[11] Patent Number: 5,236,267

[45] Date of Patent: Aug. 17, 1993

[54] TRANSFER RIBBON CASSETTE

[75] Inventors: Yoshinobu Masumura, Amagasaki; Takayasu Hongo, Kobe, both of Japan

[73] Assignee: Kanzaki Paper Manufacturing Co., Ltd., Tokyo, Japan

[21] Appl. No.: 858,853

[22] Filed: Mar. 27, 1992

[30] Foreign Application Priority Data

Mar. 28, 1991 [JP] Japan ..... 3-093222

[51] Int. Cl.[5] ..... B41J 33/16; B41J 33/14

[52] U.S. Cl. ..... 400/223; 400/208; 400/236

[58] Field of Search ..... 400/207, 208, 208.1, 400/223, 236, 236.1, 236.2

[56] References Cited

U.S. PATENT DOCUMENTS 4,973,983 11/1990 Yamamoto et al. ..... 400/208

FOREIGN PATENT DOCUMENTS 0283971 11/1988 Japan ..... 400/208

OTHER PUBLICATIONS

Sears Catalog, Craftsman Tools 1981/82 Sears Roebuck & Co.

*Primary Examiner*—Edgar S. Burr
*Assistant Examiner*—Lynn D. Hendrickson
*Attorney, Agent, or Firm*—Morgan & Finnegan

[57] ABSTRACT

A transfer ribbon cassette including a cassette case rotatably supporting first and second reels of the same shape disposed in the same plane, wherein ribbon exposing openings are formed, in the opposite sides of the cassette, parallel with the common side tangents to the cylindrical surfaces of the two reels, the cassette case and cassette interior being of symmetrical construction with respect to an axis parallel with and intermediate between the reel axes; and wherein a thermal transfer ribbon is wound on one of the first and second reels using as the delivery side at first, the delivery end of the ribbon being secured to the other reel in an S-shaped pattern so that the ribbon can be taken up.

3 Claims, 4 Drawing Sheets

TRANSFER RIBBON CASSETTE

BACKGROUND OF THE INVENTION

The present invention relates to a transfer ribbon cassette and particularly to a cassette having mounted therein a pair of ribbon rolls having an improved ribbon winding pattern from one ribbon roll to the other.

A conventional transfer ribbon cassette in a line printer is seldom reused, after the ribbon has been completely wound from the reel on the ribbon pay-out part to the reel on the ribbon take-up part, for such purpose, for example, as to utilize any remaining ink on the ribbon. If it is possible to reverse the front and back surfaces of the cassette corresponding to opposite sides of the ribbon rolls, the ribbon is rewound, with the former ribbon take-up part now becoming the pay-out part, the take-up reel being driven in the same direction of rotation as in the initial load of the cassette. In the case where a cassette receptacle means does not allow one to reverse the cassette surfaces, it may be preferable to invert the cassette by turning it in the plane of rotation of the ribbon rolls, or ribbon winding (or rewinding), through 180°.

However, in the conventional ribbon cassette, when such a plane inversion of the cassette has been made for rewinding operation, the reel which becomes the take-up reel must be driven in the opposite direction of rotation from the direction of rotation of the original take-up reel in the original load of the cassette. It should be noted that with the conventional ribbon cassette a cassette receiving arrangement is provided having a driving gear engaged with a gear of the reel as the take-up part, the cassette receiving arrangement having a brake mechanism and a back-tension mechanism to be associated with the other reel, so that the cassette receiving arrangement will be more complicated for a plane inversion rewinding operation. In addition, the arrangement will be much more complicated for a normally rewinding operation without any inversion of the cassette.

Nevertheless, it is considered that plane inversion of a ribbon cassette and the rewinding operation as described above is advantageous to address the relation between printing defects on a printed sheet and the surface exhibition of the ink ribbon.

In the ribbon cassette in general use, the ribbon has an ink layer on only one surface, as described above. Recently, a ribbon having ink layers on both surfaces is being developed. In such ink ribbon, it is convenient to devise an arrangement such that when one ribbon surface has been used, with the ribbon completely wound from one reel to the other, the cassette is reset by inverting itself through 180° in the ribbon winding direction or in the plane of rotation of ribbon rolls to use the ink layer on the opposite surface.

In such cassette resetting system based on plane inverting, the duration of use of the same cassette tends to be long, and the cleaning or inspection of the head or the reverse setting of the cassette results in the frequent slacking of the ribbon; thus, it is desired to make it possible for the user to rewind the ribbon to remove the slack in a simple and reliable manner without putting his hands on the ribbon. The reason is that if he puts his hand on the ribbon, the ribbon tends to wrinkle along its width and thereby degrades the printing quality.

Accordingly, it is a primary object of the present invention to provide a novel transfer ribbon cassette capable of a rewinding operation by driving a reel positioned at take-up side in the same direction of rotation with that of the original take-up reel, when the cassette is inverted in the plane of rotation of ribbon rolls.

It is another object of the present invention to provide a novel ribbon cassette having a two-surface type ink ribbon mounted therein, with the transfer ribbon cassette having a mechanism allowing the user to remove slack in the ribbon simply and reliably.

SUMMARY OF THE INVENTION

In achieving the above objects, the present invention constitutes a transfer ribbon cassette including a cassette case rotatably supporting first and second reels of the same shape disposed in the same plane, wherein the cassette case has ribbon exposing openings formed in opposite sides parallel with the common side tangents to the cylindrical surfaces of the two reels, the cassette case and cassette interior being of symmetrical construction with respect to an axis parallel with and intermediate between the reel axes; and wherein a thermal transfer ribbon is wound on one of the first and second reels used as the ribbon supply side at first, with the delivery end of the ribbon being secured to the other reel in an S-shaped pattern so that the ribbon can be taken up.

In accordance with another constitution of the invention, the above cassette case includes a thermal transfer ribbon having ink layers formed on the opposite surfaces thereof.

Further, the present invention constitutes a mechanism for removing slack in the transfer ribbon the cassette comprising a circular guide plate opposed to and spaced from the corresponding cassette case wall surface from axial one end in the ribbon winding range in the first and second reels, the guide plate being formed with notches around its outer periphery for driving it by finger tip.

As described above, the ink ribbon wound on the first and second reels in the cassette case in an S-shaped pattern has its surfaces respectively opposed in the same form to ribbon exposing openings formed on opposite sides of the case; therefore, if this cassette case is reset by inverting it through 180° in the ribbon winding direction, then the ribbon can completely be rewound by the same mechanism as the original setting, while in the case of the ribbon having the ink layers on the two surfaces, the opposite two layers can be thoroughly used.

Thus, the complete rewinding of the ribbon having one surface ink layer in the cassette allows an inspection of the surface of the ribbon for investigating the cause of any printing trouble, such as print missing, print density unevenness, poor quality of printing, or the like, if any, whether or not it is a result of the ribbon.

Further, since there is some distance between the guide plate for removing ribbon slack and the axial end in the ribbon winding range of the first and second reels, it is possible for the user to manipulate the guide plate with a finger tip without touching the ribbon edges; thus, it is clear that the aforesaid disadvantage is eliminated. In addition, even if the outermost layer of the ribbon on the take-up side is axially deviated to some extent as it is swung during the winding of the ribbon from one reel to the other, this will not result in the ribbon edges contacting the guide plate; thus, excessively thick winding or wrinkling due to such deviation hardly takes place.

DESCRIPTION OF THE EMBODIMENTS

Figure 1:
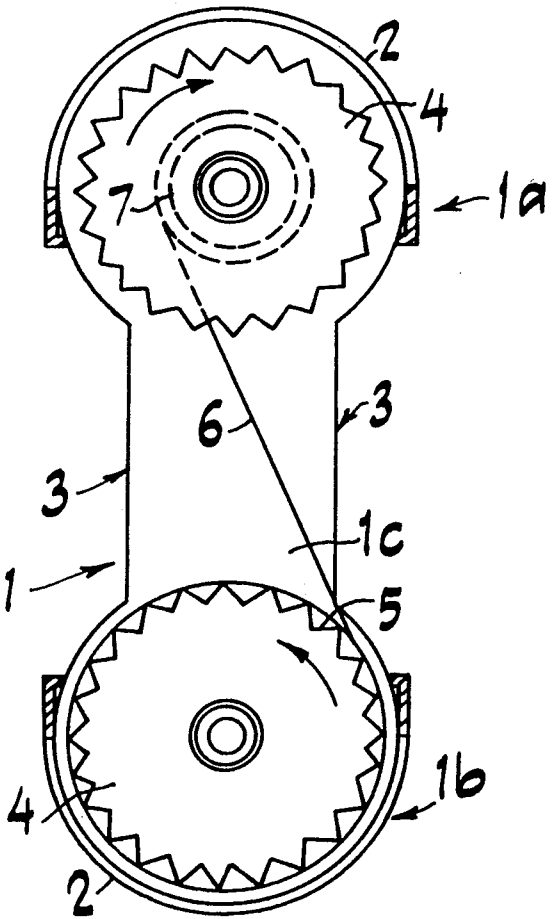
FIG. 1 is a front view, partly broken away, showing the construction of an embodiment, with a front plate being removed.

FIG. 1 shows a ribbon cassette, in section, with a front plate removed, according to an embodiment of the invention. A cassette case 1 comprises a first reel side 1*a* which is substantially circular and a second reel side 1*b* of similar shape, interconnected by a connecting portion 1*c* having a width smaller than the diameter of said first and second reel sides. Each of the reel sides 1*a* and 1*b* comprises opposed circular plates and an arcuate guard wall 2 having a width corresponding to the distance between the opposed circular plates, and the opposite sides of the cassette have symmetrical openings 3 defined by the opposite ends of the arcuate guard wall 2. A rotatable guide plate 4 disposed close to the front or back plate (in FIG. 1, front plate) of the cassette case is installed in each of the reel sides 1*a* or 1*b*. The outer periphery of each guide plate 4 has an outer diameter slightly smaller than the inner diameter of the arcuate guard plate 2 of the cassette case 1 and is formed with notches 5 for manipulation by the finger tip of a user. A ribbon 6 having an ink layer on each or both of the opposite surfaces thereof is wound on a reel 7 which is integral with the guide plate 4 and which is rotatably supported on the front or back of the case 1. The delivery end of the ink ribbon 6 completely wound on the second reel side 1*b* is attached to the reel 7 on the first reel side in an S-shaped pattern (in FIG. 1, reversed S-shaped) so that it can be taken up.

The cassette case of the embodiment described above has a construction symmetrical with respect to an axis which passes intermediate between the axes of the first and second reel sides 1*a* and 1*b* and which is parallel with the reel axes.

Figure 2:
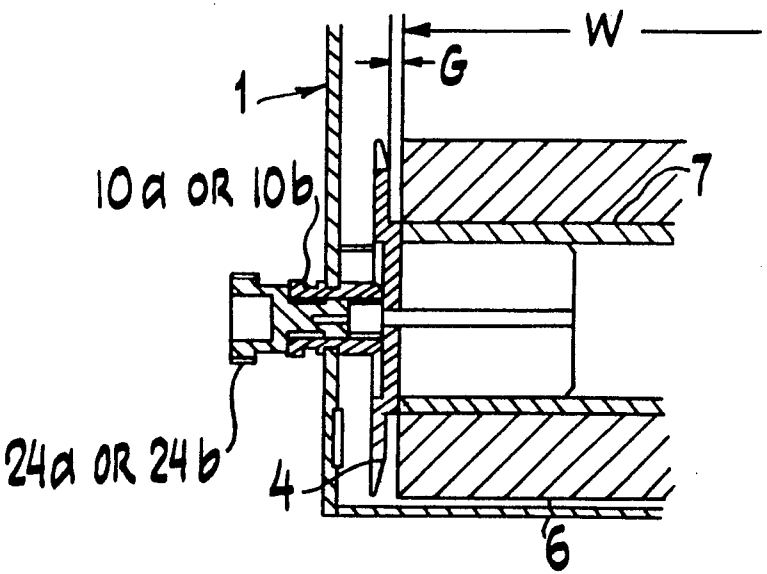
FIG. 2 is a fragmentary side view, in section, of the embodiment of the invention shown in FIG. 1.

In FIG. 2, the distance G between the guide plate 4 of the cassette case 1 and one axial end of the winding range of the ribbon 6 on the reel 7 integral with said guide plate 4 is about 3 mm, with the ink ribbon width W being about 220 mm. As a result of experiments with various ribbon widths, it has been found that the distance G must be at least about 1 mm. Further, in the embodiment, the outer diameter of the take-up reel (i.e., the inner diameter of the ribbon roll) is about 40 mm, with the initial outer diameter of the ribbon roll on the supply side about 90 mm. As considered from these conditions, it is desirable that the distance G between the guide plate and the axial end of the reel be from about 15/1000 to about 5/100 of the ribbon width W.

Naturally, when the cassette case 1 is set in the printer, it is guided by a guide reel or the like in the printer exposed from the corresponding opening 3 so that it passes through the position associated with the thermal head. Since this guide is applied to either of the two openings 3, it is clear that a 180° inverse setting in the ribbon winding direction of the cassette case 1 is possible.

Further, since the notches 5 in the outer peripheries of the guide plates 4 are exposed in the openings 3 in the vicinity of the arcuate guard wall 2, the user is allowed to rewind the ribbon by manipulating the guide plates 4 by finger tip so that ribbon slack can be easily removed.

Figure 3A:
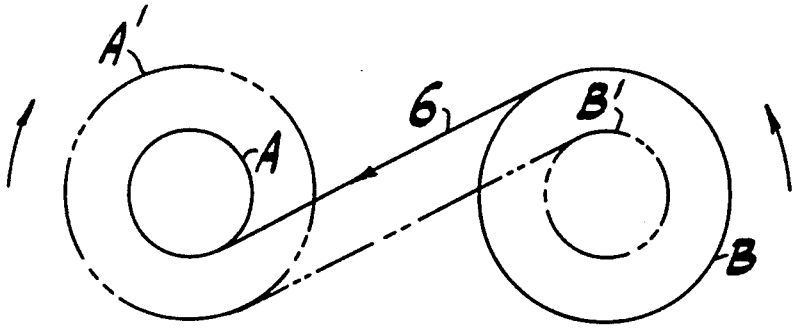
FIGS. 3A and 3B are a schematic diagram showing the relation between the original loading of the ribbon cassette having the "S" shaped ribbon winding pattern of the invention for original use, and the in-plane inverted load of the same cassette for rewinding use.
Figure 3B:
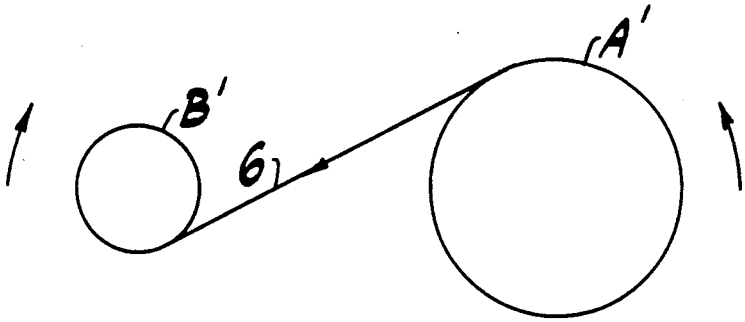

The relation between the original load of a ribbon cassette having the "S" shaped winding pattern according to the invention and the inverse load for rewinding of the same cassettes confirmed by referring to FIGS. 3A and 3B. When a winding operation on a ribbon roll A at the take-up side and a ribbon roll B at the pay-out side in the original load FIG. 3A is completed, they become an expanded ribbon roll A′ and a core roll or reel periphery B′, respectively. When the cassette is inverted in the plane of rotation into the next load FIG. 3B, a similar geometric relation between both rolls with that of the original is established. Therefore, the rewinding of the ribbon can be made by driving the roll B′ at the left side in FIG. 3B in the same rotational direction as the roll A at the left side in the original load FIG. 3A.

Figure 4A:
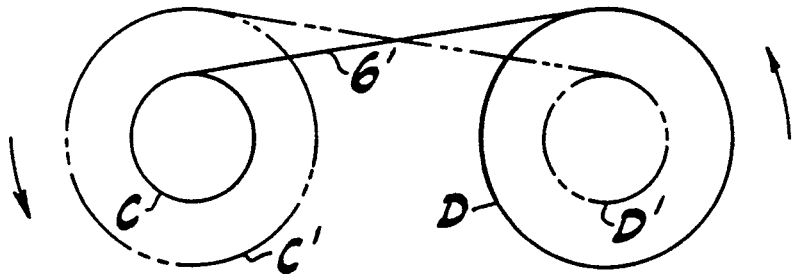
Fig. 4(a) (PRIOR ART)
FIGS. 4A and 4B are a similar schematic diagram as shown in FIGS. 3A and 3B with respect to a conventional ribbon cassette having a normal or parallel-type ribbon winding pattern.
Figure 4B:
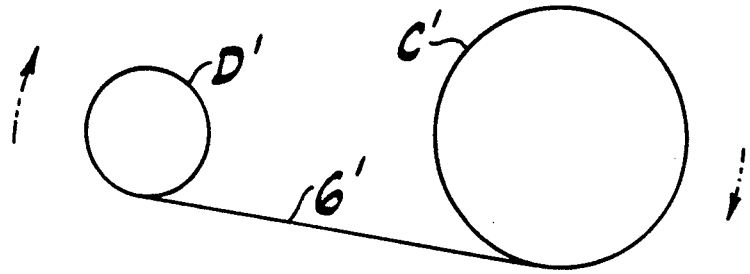
Fig. 4(b) (PRIOR ART)

In contrast, as shown in FIG. 4, for the conventional parallel winding pattern of a ribbon cassette, the diameter of core roll D′ at the take-up side in the inverse load FIG. 4B is shrunk from the diameter of the roll D at the take-out side in the original load FIG. 4A, so that roll D′ must be driven in the opposite rotational direction to that of the roll C at the take-up side in the original load. Similarly, the expanded take-out roll C′ in the inverse load FIG. 4B grown from the roll C in the original load FIG. 4A must be rotatable in the opposite direction with respect to the delivery roll D in the original load FIG. 4A for rewinding.

Figure 5:
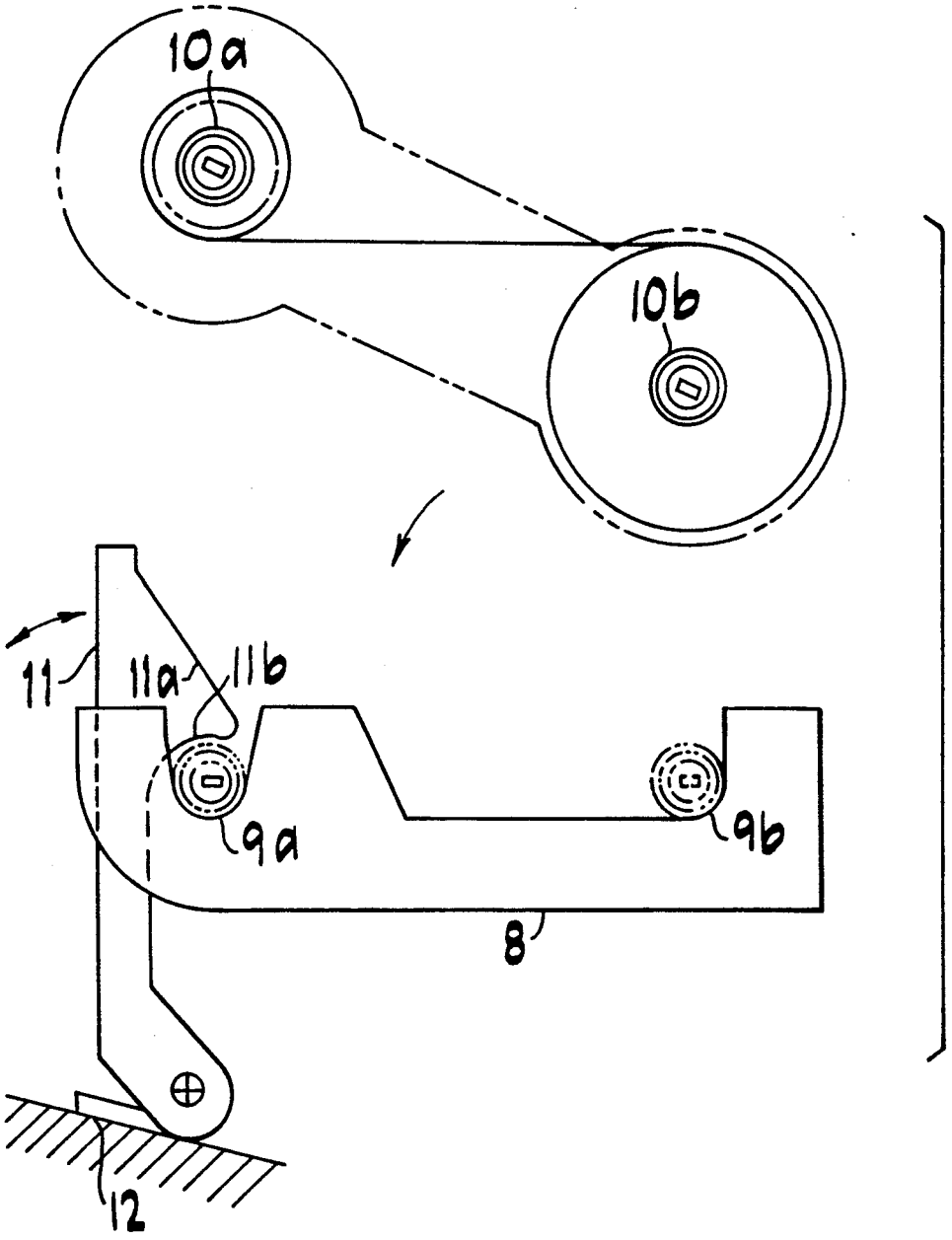
FIG. 5 is a schematic view showing a cassette receptacle frame with the ribbon cassette as shown in FIGS. 1 and 2 going to be loaded thereto.

Referring now to FIG. 5, there is shown the manner of loading the ribbon cassette shown in FIGS. 1 and 2 onto a cassette receptacle embodiment according to the invention. A cassette receptacle B has bearing portions 9*a* and 9*b* at the opposite ends thereof for receiving reel shafts 10*a* and 10*b*, respectively. The bearing portion 9*a* is associated with a holding lever 11 having an edge 11*a* which is biased by a spring 12 to hold the shaft 10*a* in the bearing portion 9*a* by the recess wall 11*b* of the edge 11*a*.

Figure 6:
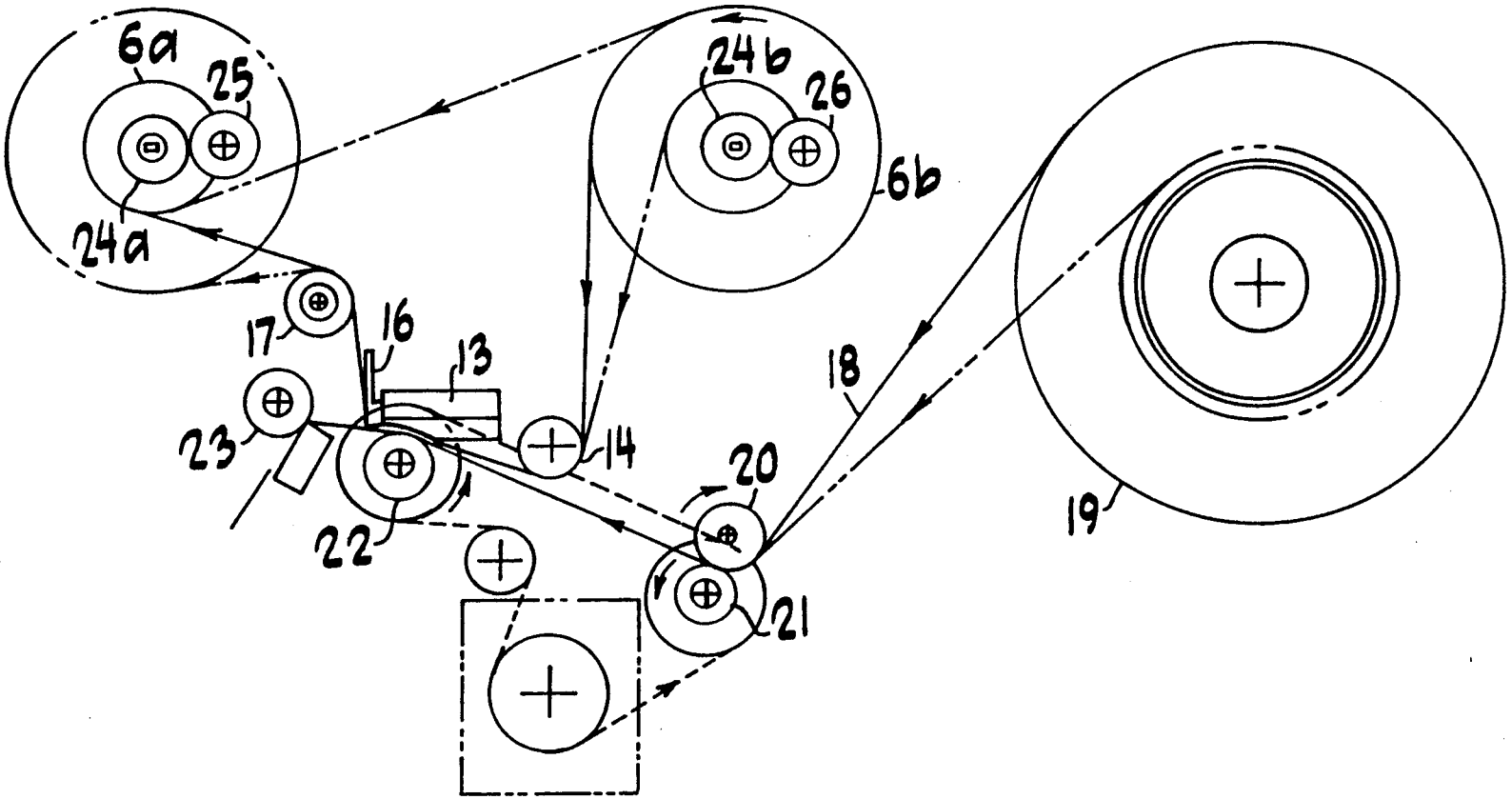
FIG. 6 is a schematic view of the interior of a printer loaded with the transfer ribbon cassette according to the invention, with a printing head therein positioned in an operative state, showing the flow of a ribbon and a paper web in the printer.

Referring to FIG. 6, there is shown the paths of both of an ink ribbon take-out from a cassette loaded on such receptacle as shown in FIG. 5 and a paper web from a paper roll. A ribbon 6 taken from one of the ribbon rolls 6*b* is transferred to a printing head 13 through a guide roller 14, and advanced to the other ribbon roll 6*a* upon which it is wound up through a ribbon dispenser 16, and another guide roller 17.

On the other hand, a paper web 18 taken from paper roll 19 passes through a pair of guide feed rollers 20, 21 to a platen roller 22 whereby the paper contacts the ink ribbon 6 to be printed thereon. The paper web 18 is further transferred to such means as a rotary cutter 23 whereby the paper is cut into printed sheets in a unit length. On the reel shaft 10*a*, a reel gear 24*a* is secured, which engages a gear 25 operatively connected to a drive motor through a reduction gear train (both not shown). On the other reel shaft 10*b*, a reel gear 24*b* is secured, which engages a gear 26 operatively connected to a brake mechanism (not shown).

As described above, the present invention provides a transfer ribbon cassette of the axis-symmetry type which is simple in construction and versatile.

What is claimed is:

1. A transfer ribbon cassette including a cassette case having case walls defining an interior portion, said cassette case rotatably supporting first and second reels having axes of rotation and surfaces of the same shape, said reels disposed in the same plane, characterized in that at least one ribbon exposing opening is formed in the opposite sides of said cassette case, said at least one ribbon exposing opening being parallel with common side tangents to the surfaces of the two reels, said cassette case and interior being of symmetrical construction with respect to an axis parallel with and intermediate between the reel axes; wherein said cassette includes a thermal transfer ribbon wound on one of said first and second reels such that in use one of said first and second reels rotates in a clockwise direction and the other of said first and second reels rotates in a counter-clockwise direction and said ribbon crosses both of said common side tangents as said ribbon moves from one of said reels to the other of said reels whereby when the cassette is first loaded onto a driving mechanism, the ribbon will have a pay-out end secured to one reel and travel in an S-shape ribbon path so that the ribbon can be taken up by the other reel, wherein the cassette may be inverted 180° in the plane of said driving mechanism so that said one of said reels used as the ribbon payout side at first is then used as a ribbon take-up reel.

2. A transfer ribbon cassette as set forth in claim 1, further including a circular guide plate opposed to and spaced from a corresponding case wall surface in axial alignment with one end of the first and second reels, said guide plate being formed with notches around its outer periphery for driving said first and second reels by the finger tip of a user.

3. A transfer ribbon cassette as set forth in claim 1, wherein said cassette case is adapted to be loaded onto a cassette receptacle, said cassette receptacle including a pair of bearing portions formed at opposite ends of the cassette receptacle for receiving a respective shaft inserted through said reels, said cassette receptacle having a holding lever defining a bearing engaging edge, wherein one of the bearing portions is operatively associated with said bearing engaging edge, said lever biased by a spring to hold one of said reel shafts in said cassette receptacle.

* * * * *